US007566231B2

(12) United States Patent
Regen et al.

(10) Patent No.: US 7,566,231 B2
(45) Date of Patent: Jul. 28, 2009

(54) THUMB DRIVE WITH RETRACTABLE USB CONNECTOR

(75) Inventors: Paul Regen, Felton, CA (US); Peter Garrett, Aptos, CA (US)

(73) Assignee: Ennova Direct, Inc., Scotts Valley, CA (US)

( * ) Notice: Subject to any disclaimer, the term of this patent is extended or adjusted under 35 U.S.C. 154(b) by 0 days.

(21) Appl. No.: 12/193,383

(22) Filed: Aug. 18, 2008

(65) Prior Publication Data

US 2008/0304225 A1 Dec. 11, 2008

Related U.S. Application Data

(63) Continuation-in-part of application No. 11/927,079, filed on Oct. 29, 2007, which is a continuation of application No. 11/473,638, filed on Jun. 22, 2006, which is a continuation of application No. 11/009,329, filed on Dec. 9, 2004, now Pat. No. 7,070,425, which is a continuation-in-part of application No. 10/903,412, filed on Jul. 29, 2004, now Pat. No. 6,979,210.

(60) Provisional application No. 60/528,645, filed on Dec. 10, 2003.

(51) Int. Cl.
*H01R 13/60* (2006.01)

(52) U.S. Cl. ..... 439/131

(58) Field of Classification Search ..... 439/131, 439/142, 135, 136
See application file for complete search history.

(56) References Cited

U.S. PATENT DOCUMENTS

| | | | | |
|---|---|---|---|---|
| 4,795,206 | A * | 1/1989 | Adams | 296/98 |
| 5,987,268 | A * | 11/1999 | Takahashi et al. | 396/538 |
| 6,536,829 | B2 * | 3/2003 | Schlecht et al. | 296/97.4 |
| 7,234,502 | B2 * | 6/2007 | O'Malley | 160/191 |
| 7,462,044 | B1 * | 12/2008 | Regen et al. | 439/131 |
| 2008/0220636 | A1 * | 9/2008 | Champion et al. | 439/131 |
| 2009/0004897 | A1 * | 1/2009 | Tang et al. | 439/131 |

* cited by examiner

*Primary Examiner*—Naeil Abrams
*Assistant Examiner*—Phuong Nguyen
(74) *Attorney, Agent, or Firm*—Donald R. Boys; Central Coast Patent Agency, Inc.

(57) ABSTRACT

A thumb drive has an elongated housing enclosing an assembly of a coupled memory and male USB connector constrained on a translation mechanism in the direction of the long dimension of the housing, with an opening at a first end of the housing through which the male USB connector may extend and retract, a top cover engaged in tracks and translatable in the long direction of the housing, and gears rotating on a shaft across the housing and engaging a gear rack along edges of the top cover and along upper edges of the memory and connector assembly. Translating the top cover forward retracts the connector into the housing, and translating the top cover rearward extends the connector from the housing.

5 Claims, 13 Drawing Sheets

THUMB DRIVE WITH RETRACTABLE USB CONNECTOR

CROSS-REFERENCE TO RELATED DOCUMENTS

The present application is a continuation-in-part of co-pending application Ser. No. 11/927,079 filed Oct. 29, 2007, which is a continuation of co-pending application Ser. No. 11/473,638, filed Jun. 22, 2006, which is a continuation of Ser. No. 11/009,329, filed on Dec. 9, 2004 and issued as U. S. Pat. No. 7,070,425, which is a continuation-in-part of patent application Ser. No. 10/903,412, filed on Jul. 29, 2004 and issued as U.S. Pat. No. 6,979,210, which claims priority to provisional application No. 60/528,645 filed Dec. 10, 2003. This present application also claims priority to provisional application Ser. No. 61/087,528, filed Aug. 8, 2008. The disclosures of the prior applications are incorporated in their entirety by reference, and priority is claimed for the disclosures as of their filing dates.

BACKGROUND OF THE INVENTION

1. Field of the Invention

The present invention is in the field of computer mass storage devices, and pertains more particularly to solid-state USB connectable drives.

2. Discussion of the State of the Art

In the computer arts there continues to be motivation for increased density and ease-of-use in mass storage devices. A solid state device known now in the art as a thumb drive was relatively recently introduced advancing the standard for both density and ease-of-use, and such hot-plug drives are made by several manufacturers. A common feature of thumb drives as known in the art is a male USB connector, and functionality to hot-plug and remove, that is, without turning off the computer to which the drive is connected and disconnected. Another common feature is a plastic protective cover for the male USB connector.

Although the advance in the mass storage art with the advent of thumb drives is dramatic, there are still some problems with such a system. For example, the plastic covers for use on the male USB connectors are not very secure, and tend to come loose and be lost. As a remedy, many manufacturers provide two and sometimes three plastic covers with each device sold, often with different colors. Still another problem is that USB ports on computers are not universally easily visible and accessible. Some such ports are on the back of tower cases which are often placed under desks or other furniture, so finding an unused USB female port for connecting the male USB connector of a thumb drive is often not trivial. When a female port is out of sight or in a darkened area, the connection must often be made by feel alone. Still further, when the thumb drive is connected to a computer, the plastic protective cover is removed, and is easily misplaced.

There are also other functions that may be accomplished with the considerable memory available with thumb drives, and their relatively easy connectivity to personal computers and other computerized appliances. One such function is as an MP3 player, to download MP3 files, such as music files, from a computerized appliance, and an ability to play these files into an ear piece, headphone or amplifier from the thumb drive.

Therefore what is clearly needed is a way to dispense with the plastic covers and still protect the male USB connector for thumb drives, a way to aid in the search for unused USB ports, and aid in the engagement of the male USB connector of the thumb drive with the female port on the computer, and a way to use the thumb drive as an MP3 player.

SUMMARY OF THE INVENTION

In one embodiment a thumb drive is provided, comprising an elongated housing enclosing an assembly of a coupled memory and male USB connector constrained on a translation mechanism in the direction of the long dimension of the housing, with an opening at a first end of the housing through which the male USB connector may extend and retract, a top cover engaged in tracks and translatable in the long direction of the housing, and gears rotating on a shaft across the housing and engaging a gear rack along edges of the top cover and along upper edges of the memory and connector assembly. Translating the top cover forward retracts the connector into the housing, and translating the top cover rearward extends the connector from the housing.

Also in one embodiment the thumb drive further comprising a film cover for the opening for the connector, the film cover attached to the top cover to extend to close the opening as the top cover translates forward, and to retract to open the opening as the top cover translates rearward.

In some embodiments there is also a fixed panel closing the housing just below the translatable top cover, the fixed panel having openings at the positions of the gears allowing the gears to engage gear racks through the panel. In some cases the fixed panel may be transparent in at least the portion visible with the translatable top cover retracted. In this case there is a light-emitting device visible through the transparent portion of the fixed panel, the device changing color with data transfer.

BRIEF DESCRIPTION OF THE DRAWING FIGURES

FIG. 1*a* is a perspective view of a thumb drive according to an embodiment of the present invention, with the connector retracted.

FIG. 1*b* is a perspective view of the thumb drive of FIG. 1*a* with the connector partly extended.

FIG. 1*c* is a perspective view of the thumb drive of FIG. 1*a* with the connector fully extended.

FIG. 2 is a perspective view of a thumb drive according to an alternative embodiment of the present invention.

FIG. 3*a* is an exploded view of the thumb drive of FIG. 2.

FIG. 3*b, c*, and *d* show details for detenting in an embodiment of the invention.

FIGS. 4*a* and 4*b* are a diagrams showing one way a protective cover may be implemented.

Figure 7A:
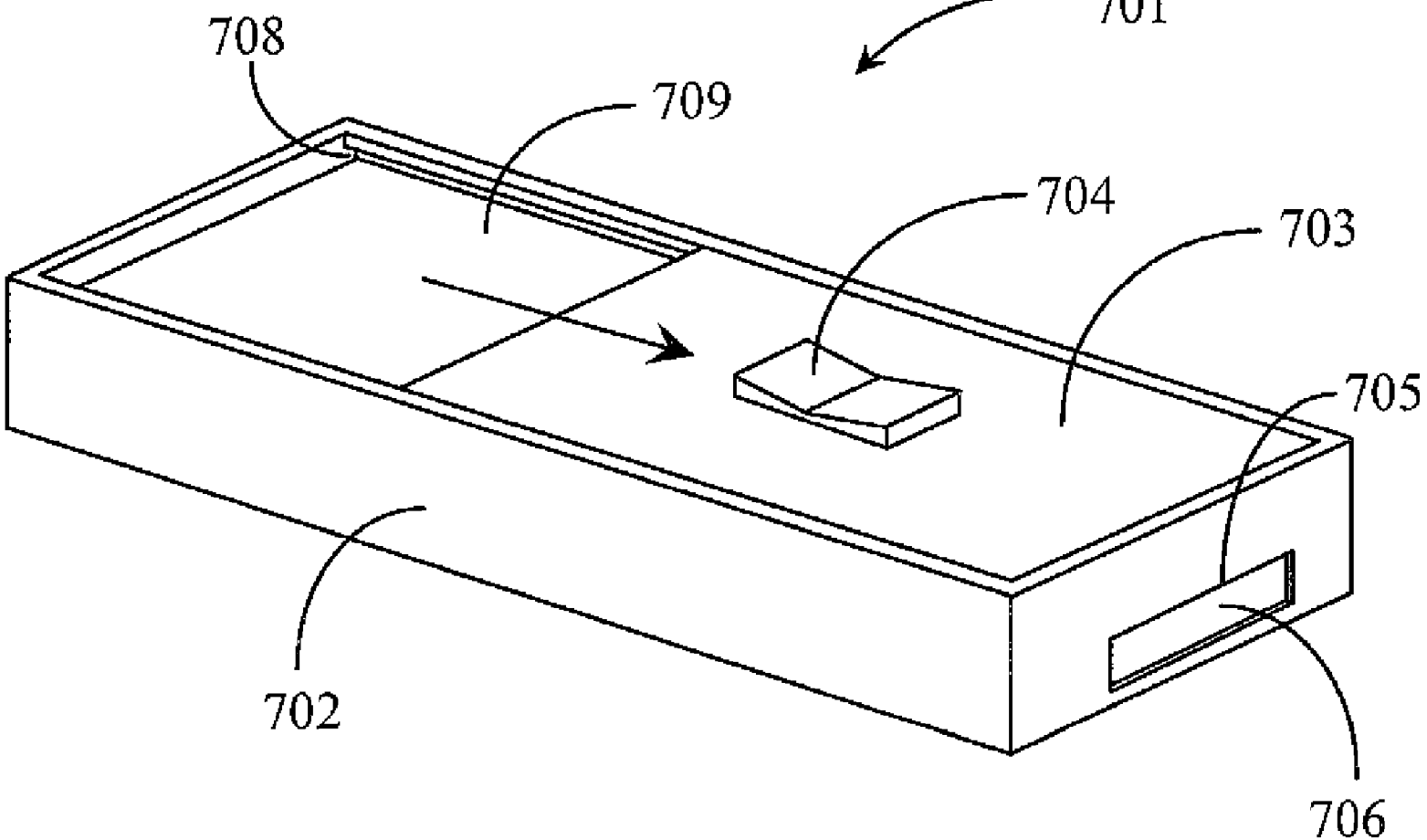

FIG. 7*a* is a perspective view of a retractable thumb drive in another embodiment of the present invention.

Figure 7B:
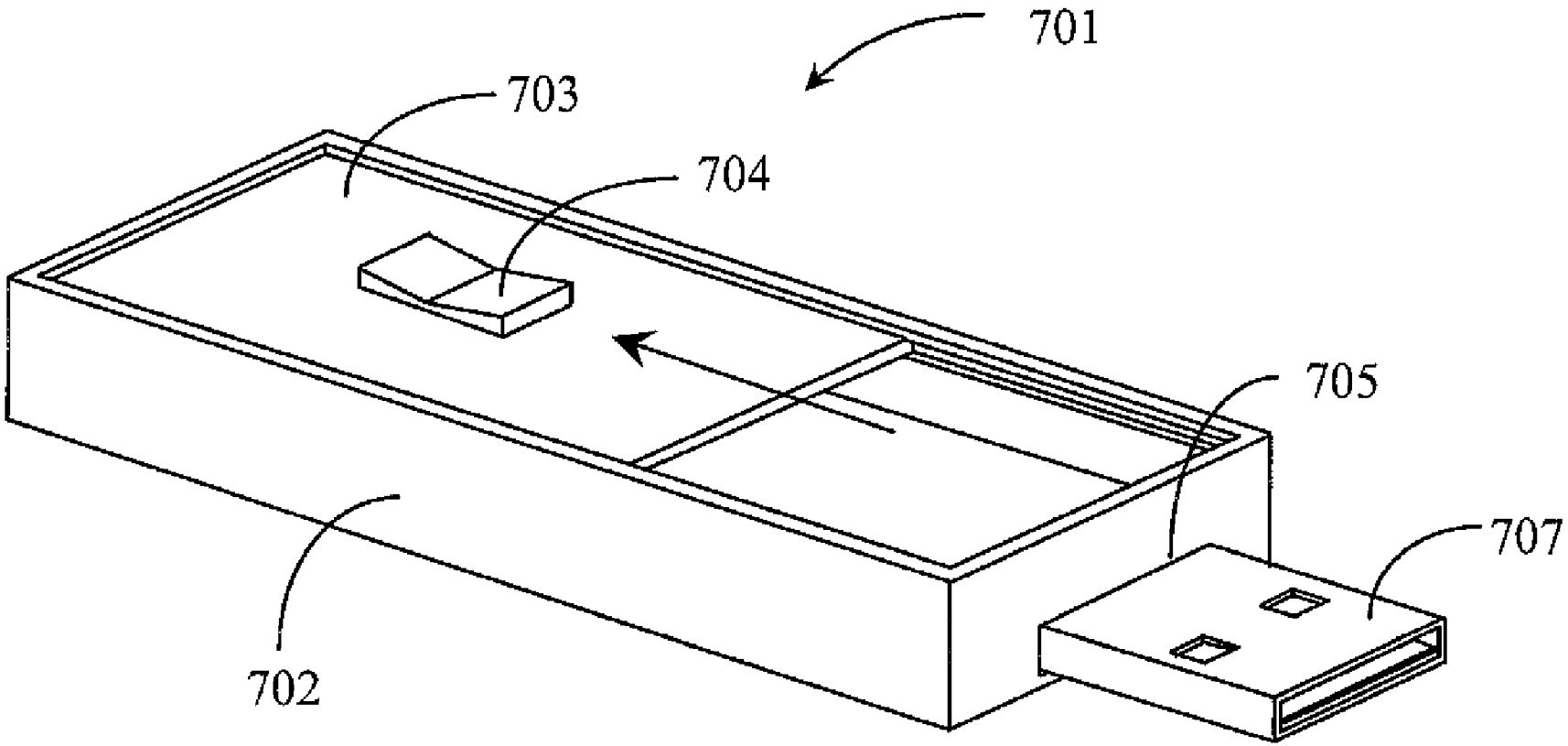

FIG. 7*b* is a perspective view of the drive of FIG. 7*a* in a different aspect.

Figure 8A:
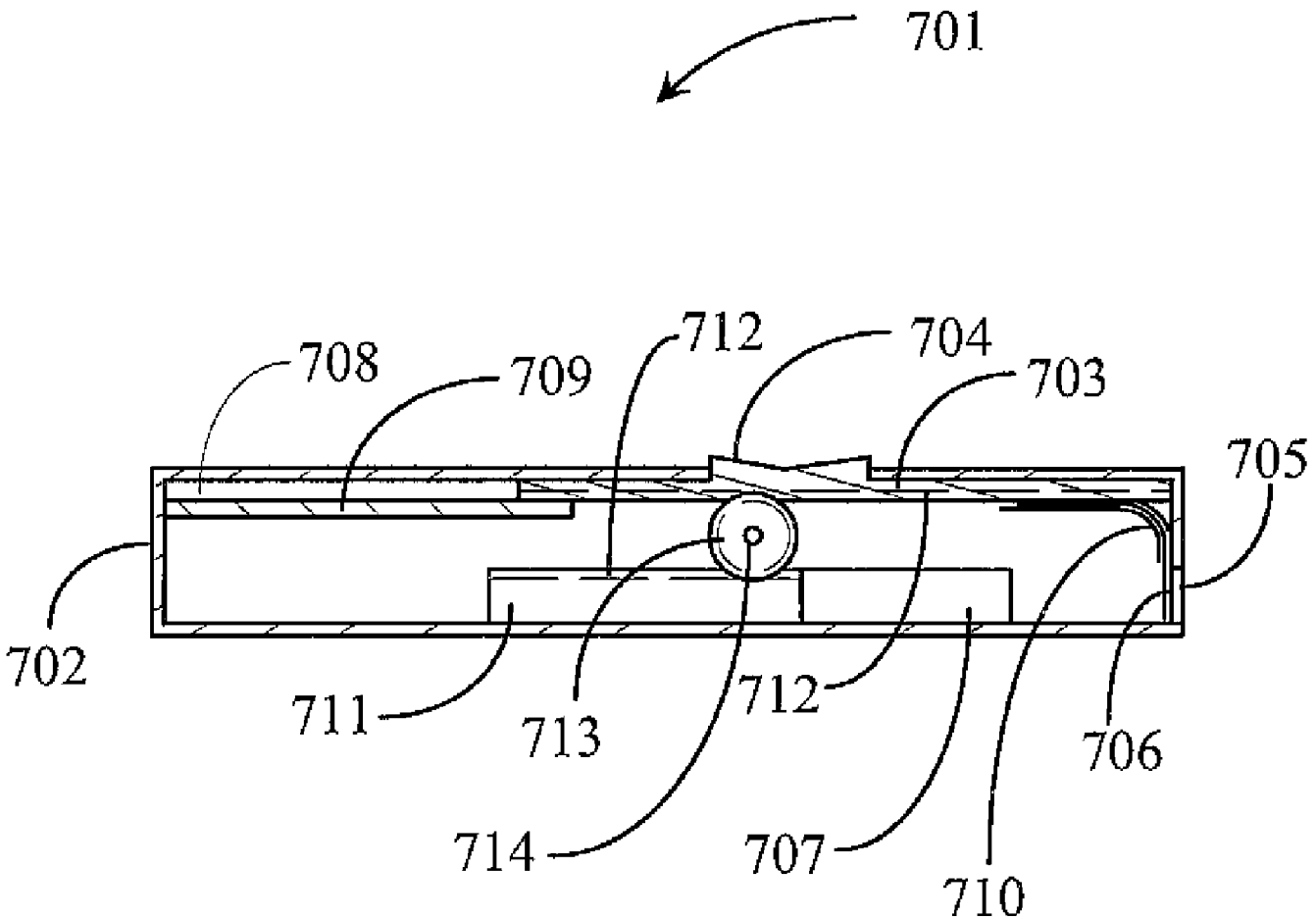

FIG. 8*a* is a cross-section of the drive of FIG. 7*a* with the connector retracted.

Figure 8B:
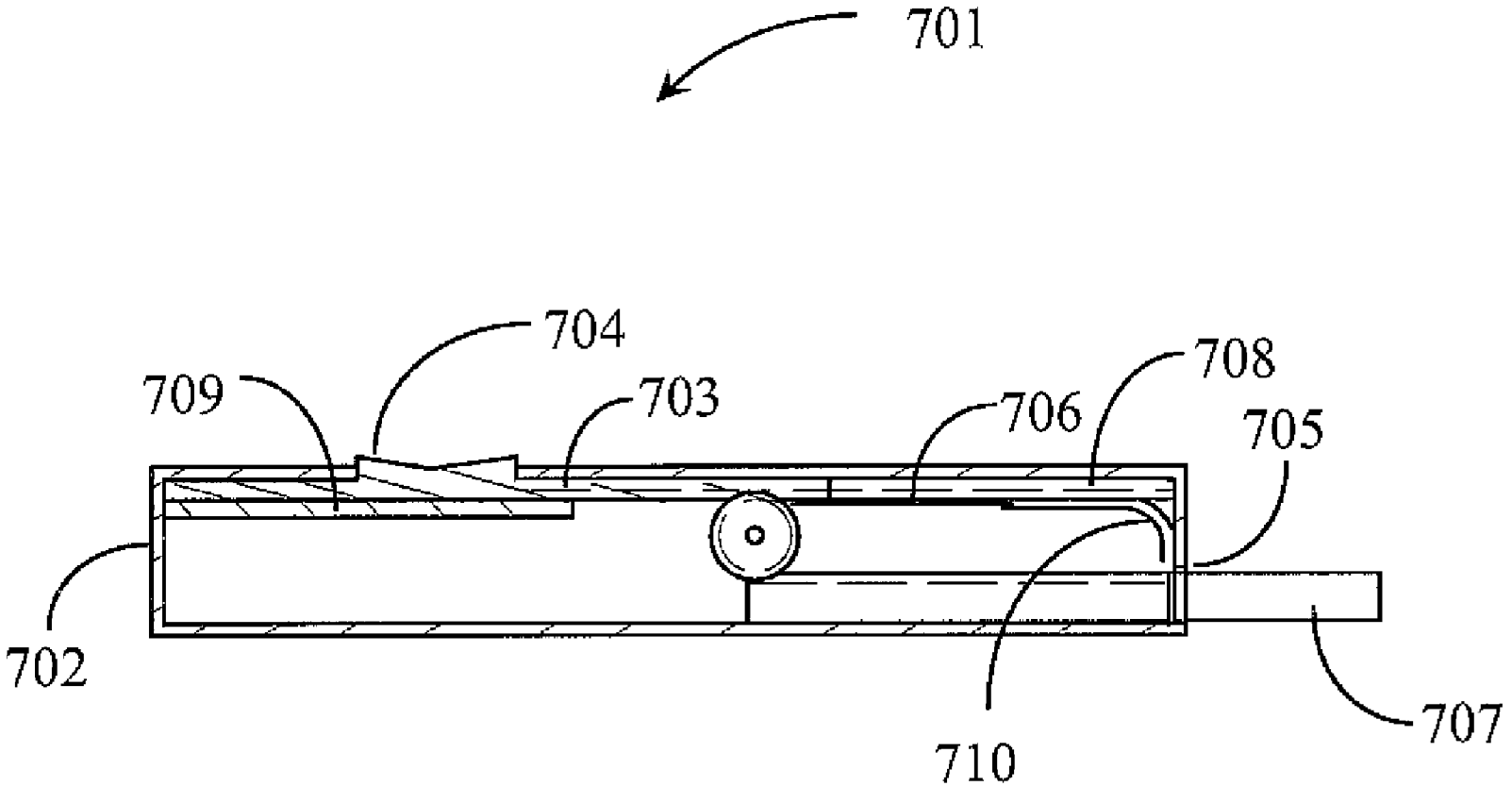

FIG. 8*b* is the cross section of FIG. 8*a* with the connector extended.

DESCRIPTION OF THE PREFERRED EMBODIMENTS

Figure 1A:
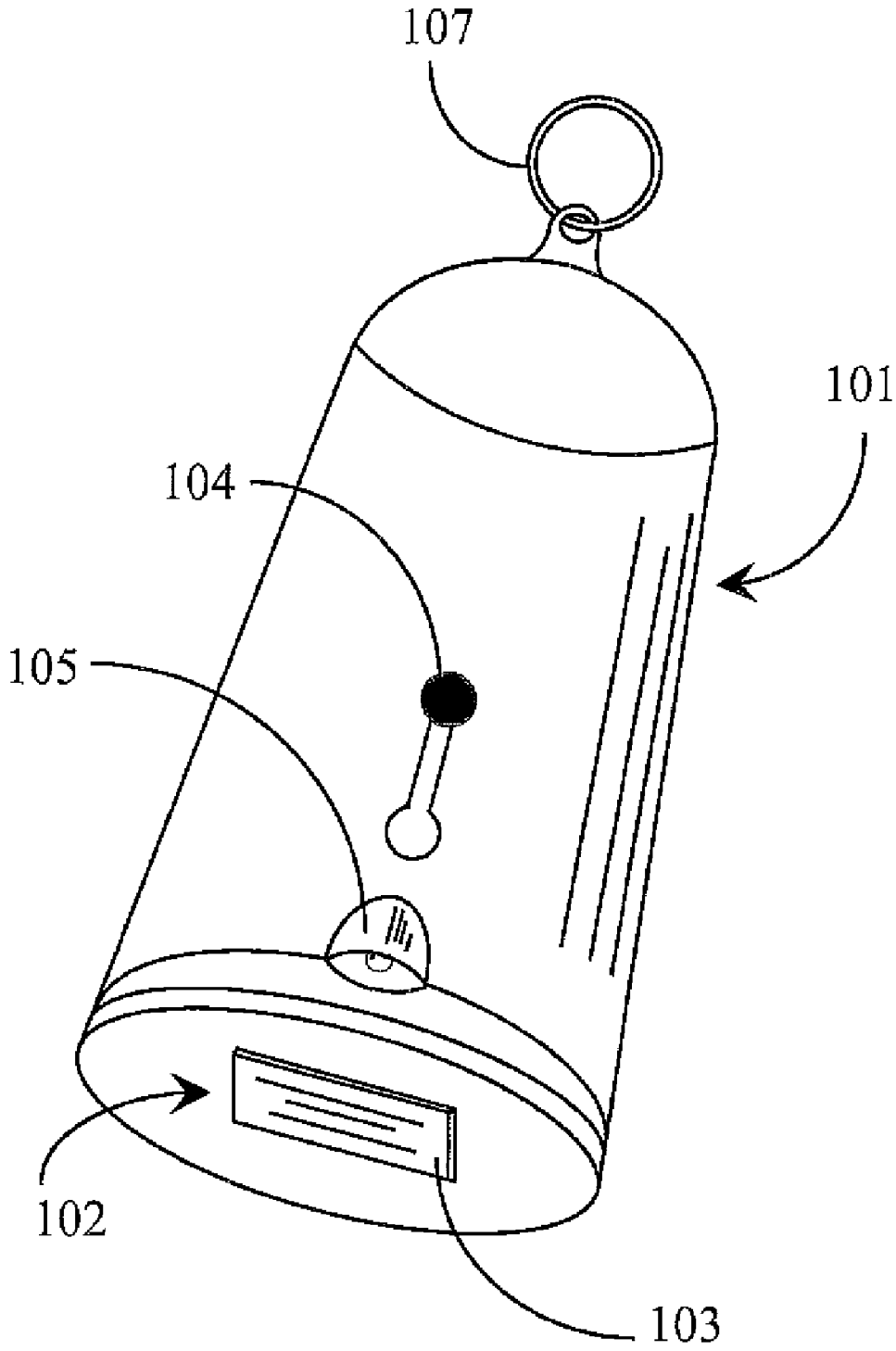

In one embodiment of the invention a thumb drive has a manually extendable and retractable male USB connector. FIG. 1*a* is a perspective view of such a drive 101 according to an embodiment of the invention.

Drive 101 has in this example a physical opening 102 generally rectangular in shape, matching the rectangular cross section of a male USB connector. Port 102 is closed, when the connector is withdrawn within a body of the thumb drive, by a retractable physical closure, such as a flap gate 103, which may be hinge mounted in one embodiment to allow passage of a male USB connector.

It will be apparent to the skilled artisan that there are a variety of ways a closure may be implemented for opening 102. Such a closure may be made of a number of different materials, such as rubber or plastic materials, and may be implemented in a number of different ways. For example, the gate could be a solid metal or rigid plastic material, and a mechanism for opening and closing may be provided also in a number of different ways.

Further to the above description, a sliding button 104 is implemented through an opening in a wall of a case for the drive. This button in one embodiment has two functions. Firstly the button is implemented in a manner to turn on a flashlight element 105 when the button is depressed. Secondly, the button is detented in a way that when depressed it may be pushed forward, causing an internal mechanism to translate forward, urging a male USB connector to extend through port 102, and to lock in place as extended. The locking in place in one embodiment is a function of the detenting of the button mechanism.

It will also be apparent to the skilled artisan that such a manual operator for translation of a mechanism to extend the male connector through opening 102 may be implemented in several ways as well, such as by a knob or a slide. In one embodiment, for example, the retractable connector is spring-loaded into the case of the thumb drive with a detent for keeping it retracted until a user trips the detent. A similar detent keeps the connector in an extended position until the user pushes the connector back into the case.

Light 105 in one embodiment is offset to one side of the thumb drive as shown, and is provided for aiding in finding a USB port on a candidate computer. The light may also be used as a utility flashlight for a number of other purposes. The skilled artisan will understand that there are a variety of ways control for the light may be provided in addition to the slide button 104, such as by a separate switch implemented through the body of the thumb drive.

Figure 1B:
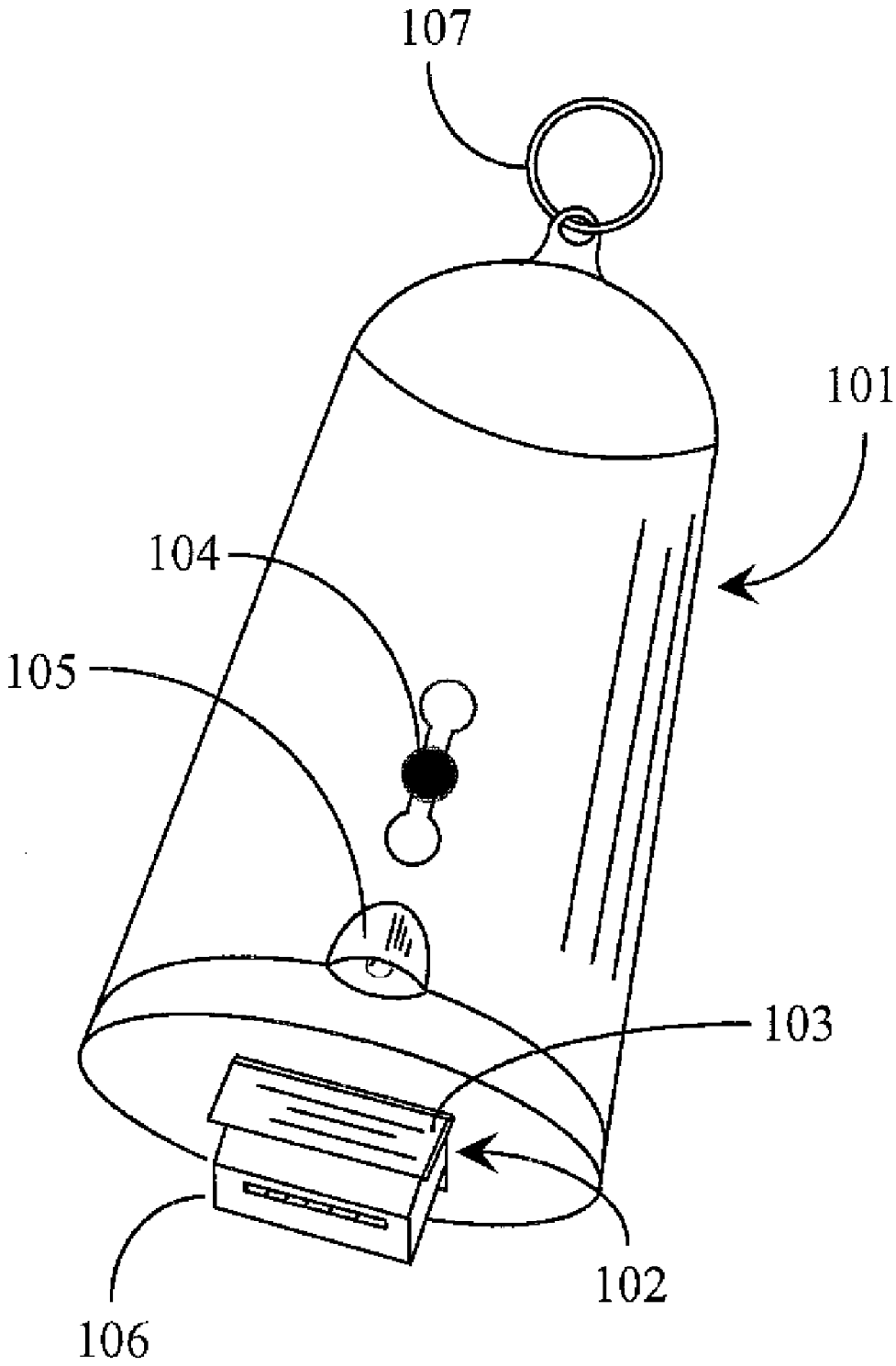

FIG. 1*b* is a perspective view of the thumb drive of FIG. 1 with a USB male connector extended part way through port 102. It may be seen that the relative position of slide button 104 corresponds to the relative extension of the USB port 106.

Figure 1C:
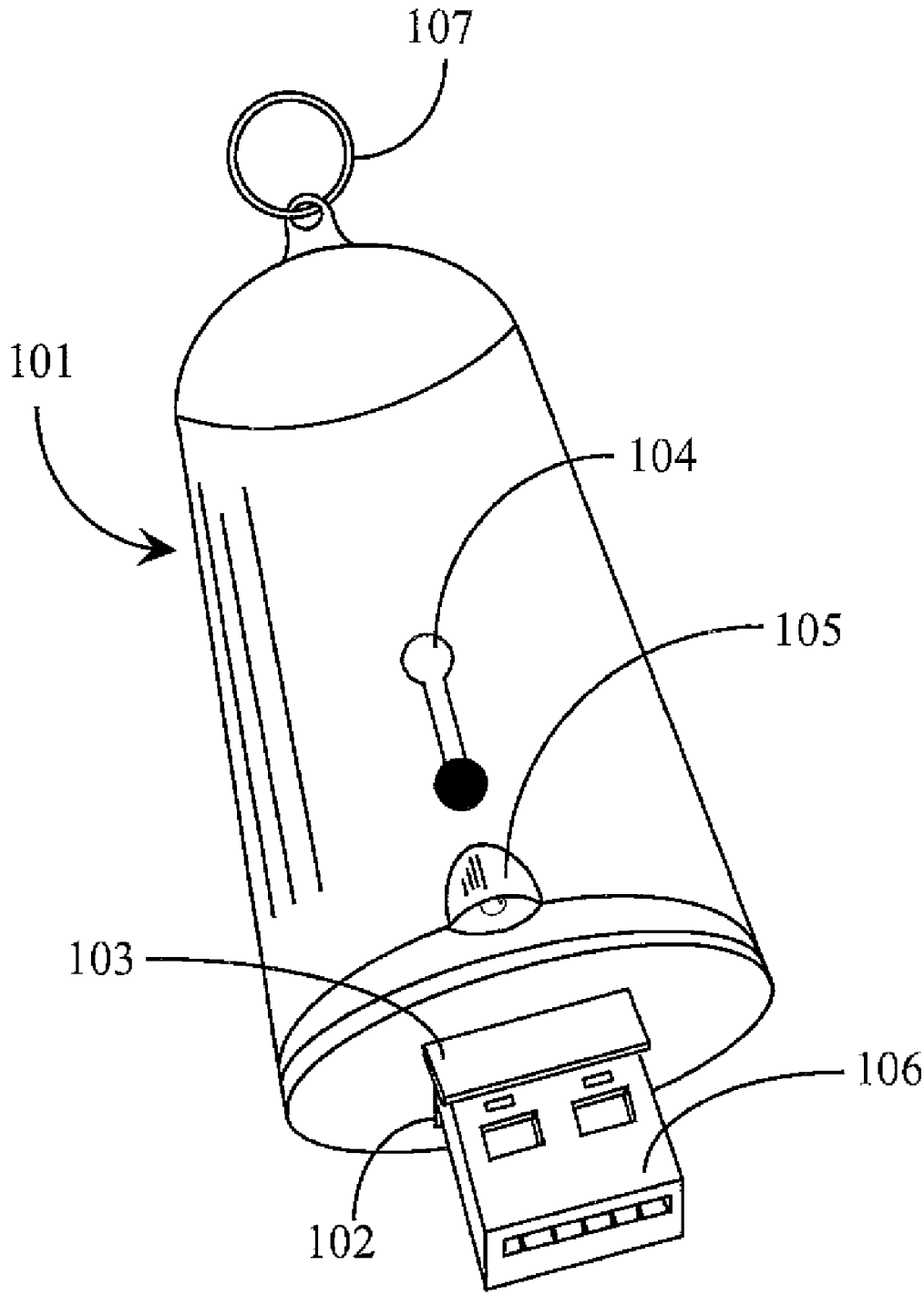

FIG. 1*c* is a perspective view of the thumb drive of FIGS. 1*a* and 1*b* with male connector 106 fully extended and locked into place. In some embodiments of the invention a connection ring 107 may be provided to facilitate attachment to a neck cord or key ring.

Figure 2:
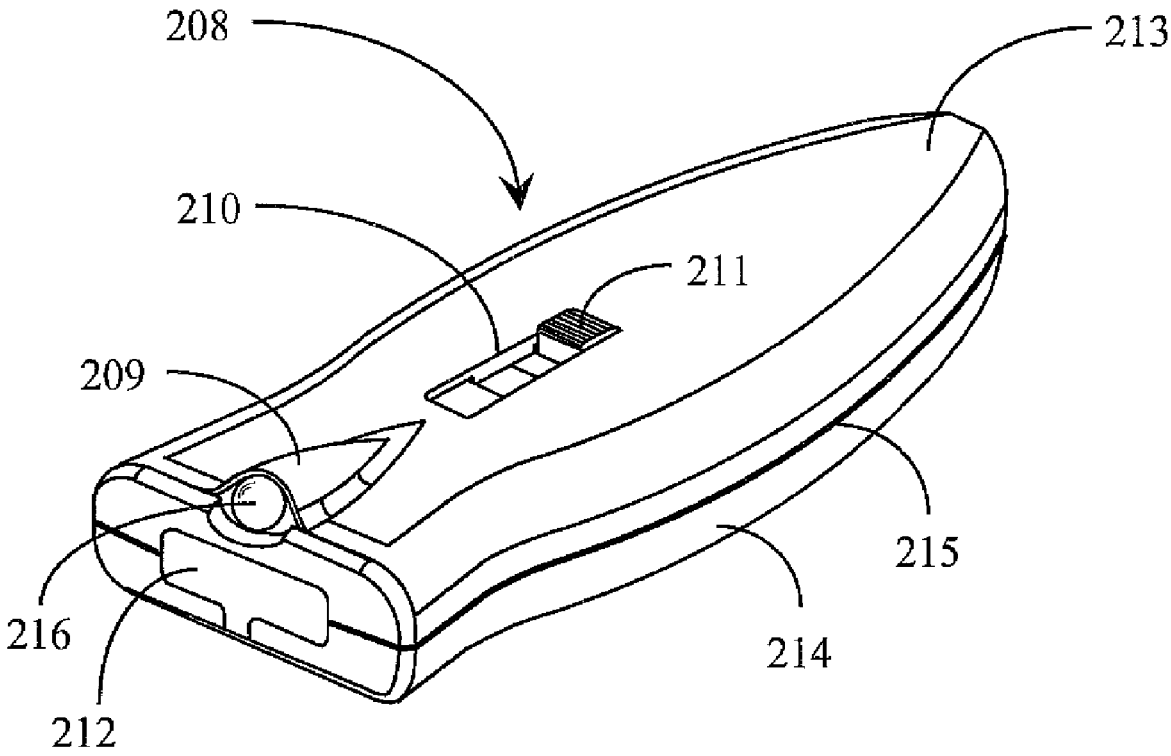

FIG. 2 is a perspective view of a thumb drive 208 in yet another embodiment of the present invention. In this embodiment a body shape is implemented that provides a more comfortable and secure grip when using the drive. Many of the elements for the embodiment shown by FIG. 2 are the same as for the embodiment shown by FIGS. 1*a*-1*c*. There is a molded body that, in this case, is made in two separate parts 213 and 214, joining along a line 215. A raised portion 209 of the upper section 213 provides a housing for a light 216, which may be one or a cluster of high-intensity LEDs or an incandescent bulb, for example. A spring-loaded button 211 is implemented through an opening 210 in section 213 for on-off input for the light 216 and slide operation for a male USB connector that may be caused to extend through door 212 by urging button 211 forward. Detents implemented in opening 210 provide for restraining the USB connector in extended or retracted position, as further described below.

Figure 3A:
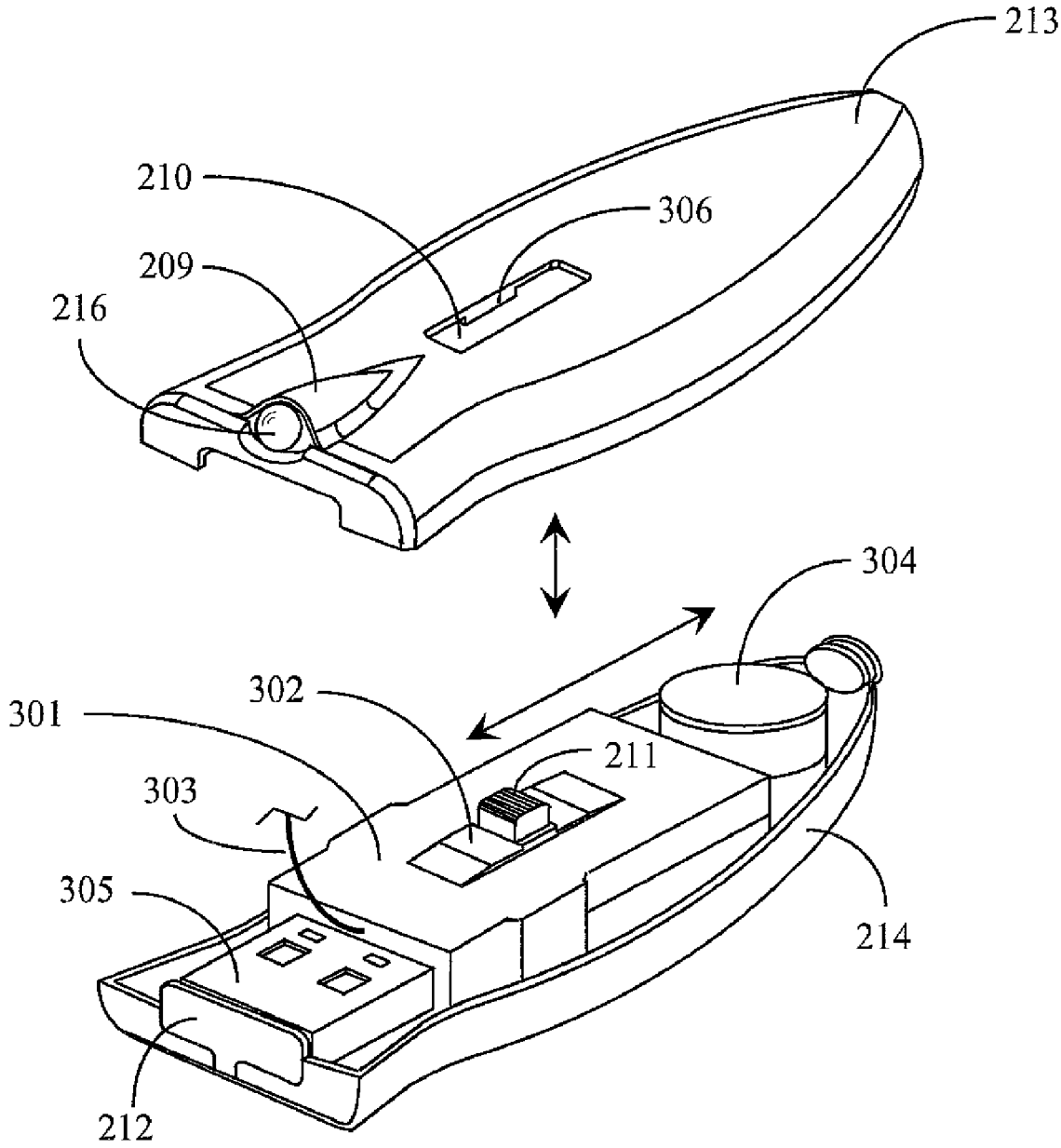

FIG. 3*a* is a partially exploded perspective view of thumb drive 208 of FIG. 2, showing some further detail of inner components. Section 213 is shown disconnected from section 214 and raised to show additional inner detail. Within the thumb drive a module 301 comprises flash memory, in quantity of perhaps 256 Mbytes, or more. Module 301 also comprises button 211 implemented in a structure 302 that allows the button to be depressed and to make electrical contact to energize light 216 through a connection path 303 from an on-board battery source 304. The battery can be any one of many sorts, such as a rechargeable battery.

The internal flash memory of module 301 is coupled to I/O contacts of a USB male connector 305 which is built into module 301. Internal connections, microprocessor, and firmware applying the microprocessor to functions of the apparatus are not shown, but will be apparent to those with skill in the art, as these mostly exist in the commercial arena at the time of filing the present application.

Module 301 in this an some other embodiments is implemented within the shell of portions 213 and 214 restrained between molded-in tracks, such that the module may be translated from a position wherein USB male connector 305 is fully withdrawn, to a position wherein the USB connector is fully extended, and back again. Detents molded into upper portion 213 in conjunction with opening 210 provide for retention at the fully withdrawn and near the fully extended positions, in concert with depressing button 211. To extend or withdraw one may depress button 211 and release it at the end of the movement. When USB connector 305 extends, door 212 is urged aside in a manner that when the USB connector is again withdrawn, the door closes again.

Figure 3B:
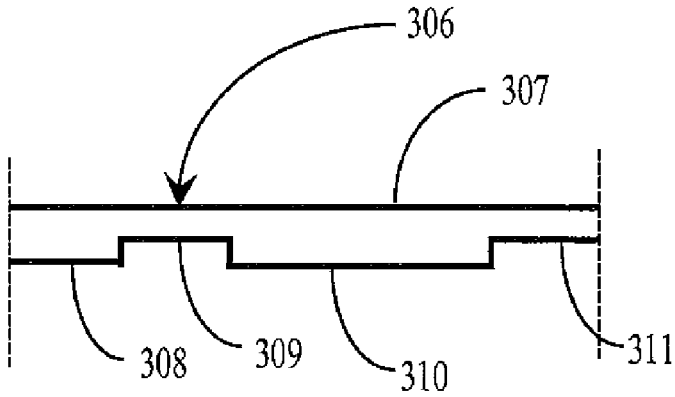

FIG. 3*b* shows one edge 306 of opening 210 of portion 213 in elevation. This edge of the opening is formed into lands at two elevations, these being lands 308 and 310 at a lower level and lands 309 and 311 at a higher level.

Figure 3C:
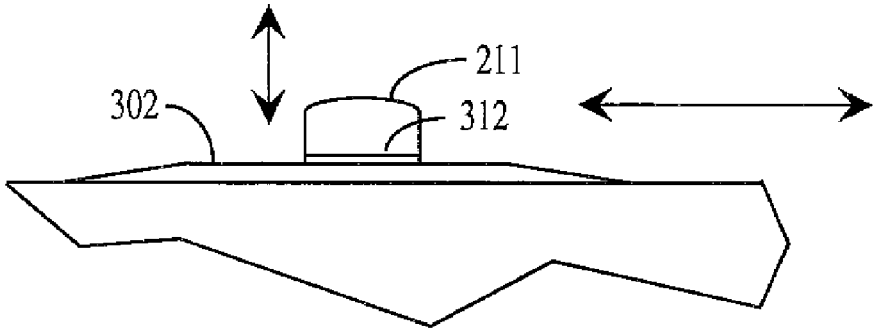

FIG. 3*c* shows button 211 and structure 302 implemented on module 301. As previously described, structure 302 allows button 211 to be depressed to make electrical contact to illuminate light 216. Button 211 further has a land 312, also seen in FIG. 3*a* in perspective that engages one of lands 308-311 in assembly, depending on the relative extension of connector 305.

Figure 3D:
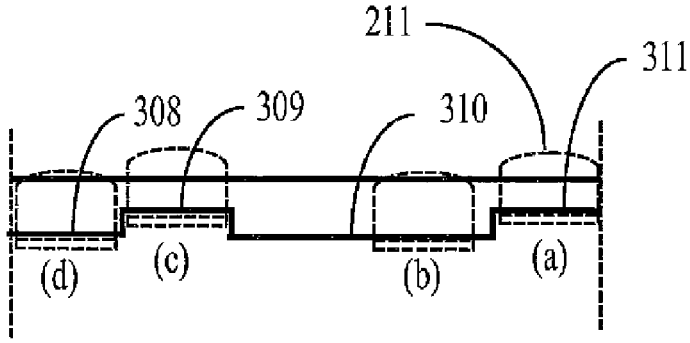

FIG. 3*d* shows edge 306 with lands 308-311 with button 211 superimposed at four different positions (a) through (d) representing four different extensions of connector 305. With button 211 in position (a) the male USB connector is fully retracted within the body of the thumb drive. Because button 211 is spring-loaded upward, this provides a detent that holds the connector retracted until a specific action by the user.

To move the connector forward, that is, to extend the connector, a user depresses button 211 such that land 312 of the button is below land 310 of edge 306. This depressing of button 211 makes electrical contact turning on light 216. Now module 301 may be moved forward by urging button 211 forward to extend USB connector 305. Land 310 ensures that the light stays on if the button is released.

Land 308 allows the user to move connector 305 to a maximum forward position, passing land 309, at which point the light will stay lit. This allows for the user to release the button while looking for a female USB port for connection, and keeps the light on.

When the female USB port is found and male connector 305 is inserted, the action of insertion will retract the male connector in the thumb drive until the spring-loaded button clicks up to land 309, providing a detent near the fully extended poison with the light off and the thumb drive connected to the appliance having the female USB port.

The skilled artisan will be aware that the detent mechanisms described above with reference to FIGS. 3*b*-3*d* are exemplary of one such mechanism that might be used, and that are there are a variety of other ways the detents may be provided.

Figure 4A:
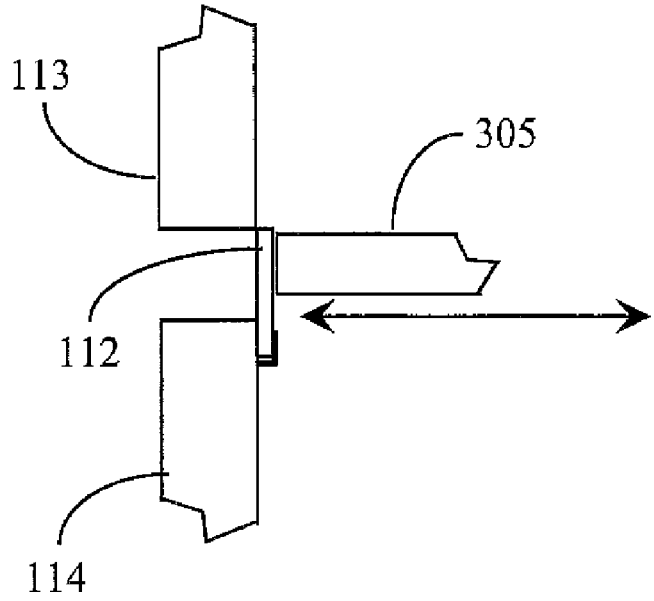
Figure 4B:
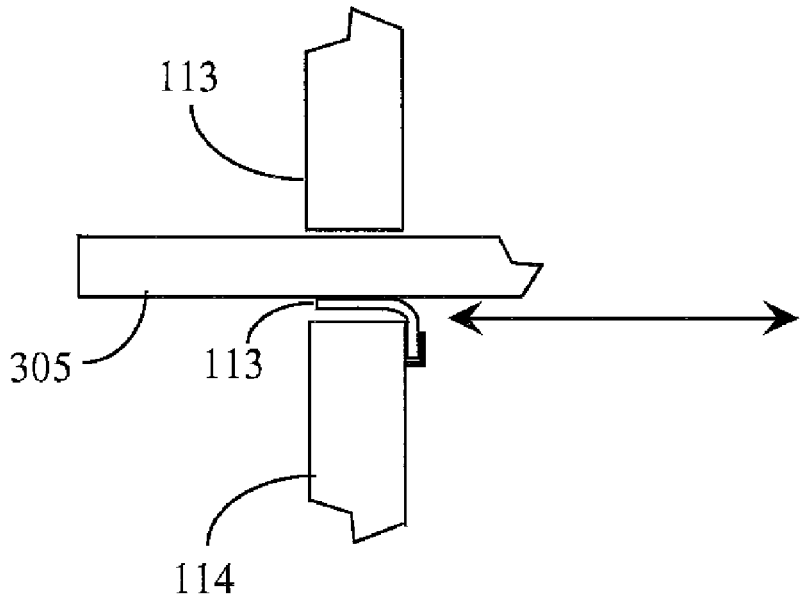

One simple rendition of a door 112 or 212 is shown in FIGS. 4*a* and 4*b*. In this example a rubber-like panel 112 is affixed behind an opening between upper and lower portions 113 and 114. As connector 305 is extended from the poison shown in FIG. 4*a* the rubber-like panel is simply urged aside, until with full extension, panel 112 is positioned as shown in FIG. 4*b*. When connector 305 is again withdrawn panel 112 springs back to an upright position as shown in FIG. 4*a*, closing the opening to dust and debris, for example.

It will be apparent to those with skill in the art that the door for the opening through which the male USB connector protrudes, such as panel 112 in FIGS. 4*a* and 4*b*, is not in and of itself the patentable feature of the invention, but a convenience to protect the internal details of the novel thumb drive when the connector is withdrawn. Simple examples of such a door have been provided, but there are a further variety of ways such a protective door might be implemented. There might be, for example, a rigid door hinged in some manner, and the door may or may not be closed by a spring detent. There are many other possibilities as well.

In embodiments of the invention described above there is no need for a protective plastic cap for the male USB connector as is common in the art at the time of filing the present application, and the light integrated into the thumb drive in some embodiments provides real aid to a user in finding and connecting to unused USB ports. The light has other uses as a simple utility flashlight as well.

Figure 5:
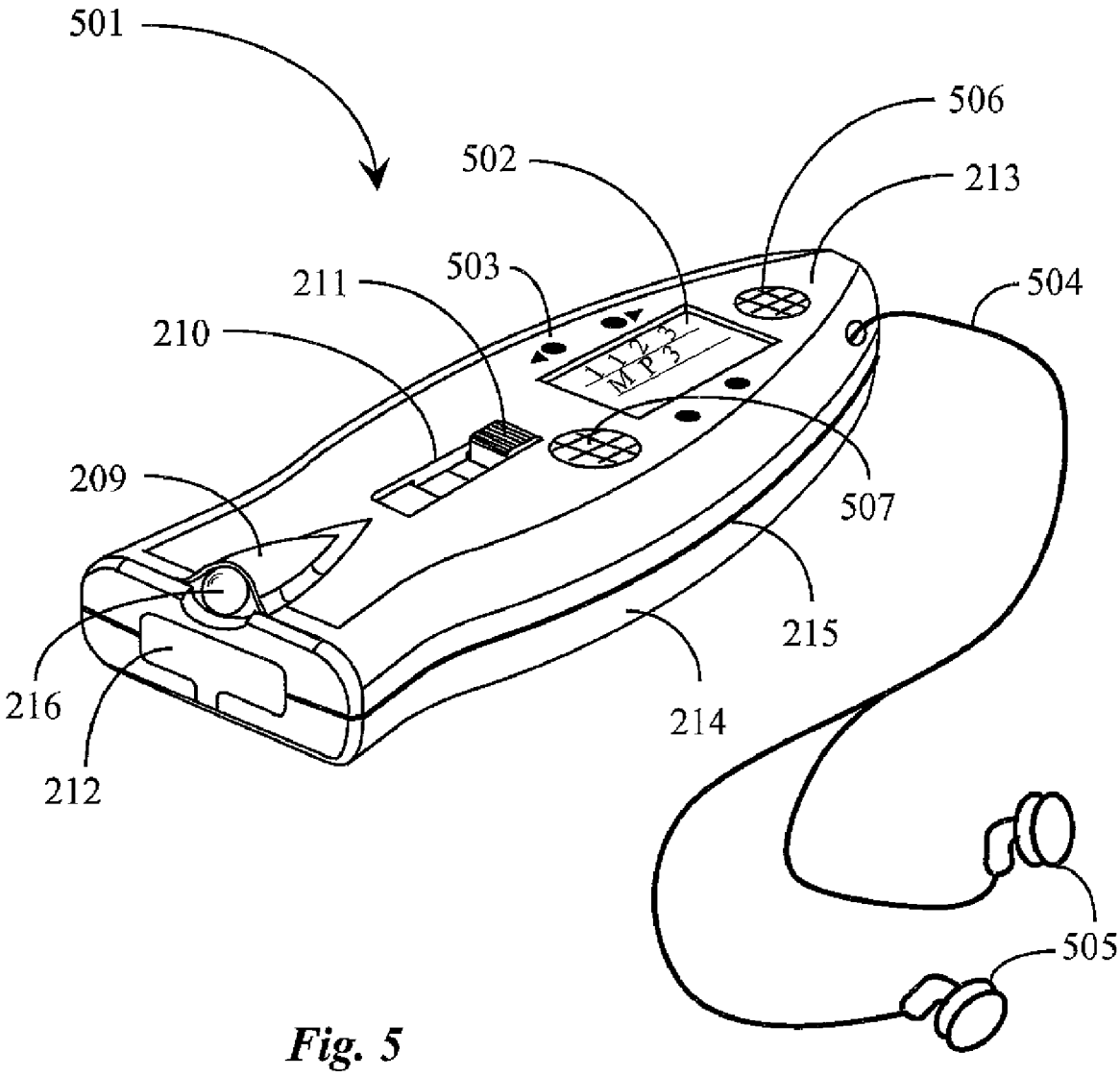
FIG. 5 is a perspective view of a thumb drive according to yet another embodiment of the invention.

In another embodiment of the present invention, illustrated in FIG. 5, further enhancement is provided such that a thumb drive 501 may also operate as a music repository and player, such as an MP3 player. In this embodiment the memory capacity of the thumb drive is controlled in the same manner that is done in the art for MP3 players and the like, so that music and other audio material may be downloaded to the unique thumb drive from a computer device, and may be played back to a user. For this purpose a display 502 is provided, which may be an LED (light-emitting diode) or an LCD (liquid crystal display) is provided, and additional firmware for internal microprocessor control is provided to manage storage of audio files, such as MP3 files, for songs, and to display and render the songs at a user's command.

Appropriate controls, such as buttons 503 for scrolling through a playlist, are provided, and audio rendition is through line 504 to a set of ear-buds 505. Earphones may be used as well, or any set of battery-powered or conversion unit powered speakers, such as those sorts of speakers used with PCs from a soundcard. In some embodiments a microphone 506 is also provided, and controls are provided for a user to record such as memorandums and notes, using the thumb drive as a personal digital recorder. A small, built-in speaker 507 may also be implemented in some embodiments.

Figure 6:
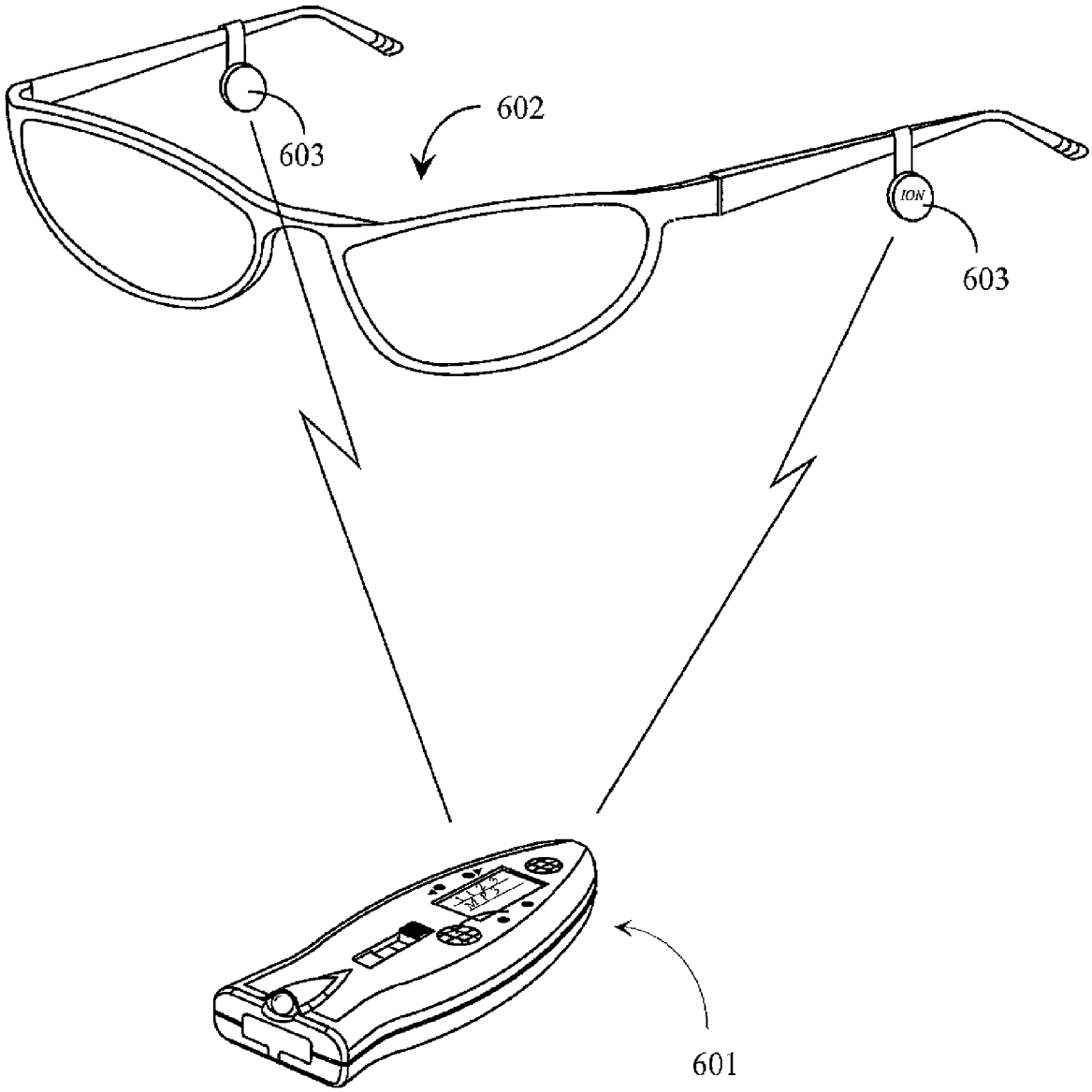
FIG. 6 is a perspective view of a thumb drive associated with a Bluetooth™ headset in yet another embodiment of the invention.

FIG. 6 is a perspective view of a thumb drive 601 associated with a Bluetooth™ headset in still another embodiment of the invention. Bluetooth™ is well-known system and protocol for wireless transmission of audio and other date over relatively short distances, and information relative to same is easily accessible to the skilled artisan. In this embodiment thumb drive 601 comprises a Bluetooth™ transmitter, which transmits to left and right earpieces 603 adapted to a pair of glasses 602, such as sunglasses. The controls for thumb drive 601 are essentially the same as described above for drive 501. In alternative embodiments the Bluetooth™ earpieces may be worn separately from the glasses, or may be associated with a hat or a cap for example.

FIG. 7*a* is a perspective view of a retractable thumb drive in another embodiment of the present invention.

A purpose of drive 701 shown in FIG. 7*a* is to provide a simplified apparatus and method for extending and retracting the male USB connector into and out of a housing enclosure, while at the same time, providing protection to the USB male connector when in a retracted position. This invention is designed to accommodate consumer products where male USB connectors are needed, such as USB Flash Drives and MP3 Players.

In one embodiment, a housing enclosure 702 houses digital memory, which may be one of several different sorts, including flash memory, a male USB connector coupled to the memory, and mechanism for holding and guiding the connector into and out of the housing. An opening 705 in one end of the housing is for extension and retracting a male USB connector (not seen in FIG. 7*a*), and in the position shown, with the connector retracted within housing 702, the opening is closed by a film-like cover 706, which may be a sheet of suitable plastic material, such as mylar.

Top cover 703 in FIG. 7*a* is engaged in guide tracks arranged along the upper inside walls of the housing, one of which (708) may be seen on one inside wall of housing 702, and the cover is movable along the tracks. An internal wall 709 serves to keep the lower internal cavity closed when the top cover is forward.

The cover has an engagement interface 704 for a user's thumb or finger, for moving cover 703 forward and backward along the guide tracks. The top cover is engaged with the coupled memory and USB port in a manner that when the top cover is in the forward position, as shown in FIG. 7*a*, the USB connector is retracted and the opening for the connector is closed by film 706. When the cover is retracted as shown in FIG. 7*b*, the film 706 is withdrawn and the USB connector is extended as shown, such that it may be engaged with a female USB connector of an external device.

FIG. 8*a* is a cross-section view lengthwise of drive 701 showing the drive in an aspect with operating cover 703 pushed fully forward and the assembly of memory 711 and USB connector 707 fully retracted. There are gear racks 712 along edges of cover 703 facing downward and on edges of memory module 711 facing upward. Two gears 713, one on each side of housing 702, turn on a shaft 714 and engage racks 712 such that moving top cover 703 in one direction translates the memory/connector assembly in the opposite direction. When a user translates top cover 703 using interface 704, connector 707 moves in the opposite direction.

Film 706 that closes opening 705 when the connector is retracted is guided in tracks 710 and fastened to the top cover so the film retracts opening for the connector to extend from the housing when the top cover is retracted translating the connector forward.

FIG. 8*b* is the same cross section as FIG. 8*a*, except that the top cover is fully retracted, fully extending the connector. In FIG. 8*b* film 706 is also retracted.

Referring again to FIG. 7*b*, when the top cover is retracted a transparent cover just below the top cover position is exposed, allowing a user to view an LED implemented on top of the memory module. The LED in some embodiments changes color when data is being transferred.

It will be apparent to the skilled artisan that there are a broad variety of changes that may be made in the embodiments of the invention described above without departing from the spirit and scope of the invention. For example, there are a broad variety of materials that may be used for various elements of the thumb drive in embodiments of the invention. The controls in those embodiments that provide audio playback can be done in several ways. There are various ways the extendable male connector may be implemented, and the like. There are a wide variety as well of ways the control functions may be implemented. Therefore the invention should only be limited by the claims which follow.

What is claimed is:

1. A thumb drive comprising:

an elongated housing enclosing an assembly of a coupled memory and male USB connector constrained on a translation mechanism in the direction of the long dimension of the housing, with an opening at a first end of the housing through which the male USB connector may extend and retract;

a top cover engaged in tracks and translatable in the long direction of the housing; and gears rotating on a shaft across the housing and engaging a gear rack along edges of the top cover and along upper edges of the memory and connector assembly;

wherein translating the top cover forward retracts the connector into the housing, and translating the top cover rearward extends the connector from the housing.

2. The thumb drive of claim 1 further comprising a film cover for the opening for the connector, the film cover attached to the top cover to extend to close the opening as the top cover translates forward, and to retract to open the opening as the top cover translates rearward.

3. The thumb drive of claim 1 further comprising a fixed panel closing the housing just below the translatable top cover, the fixed panel having openings at the positions of the gears allowing the gears to engage gear racks through the panel.

4. The thumb drive of claim 3 wherein the fixed panel is transparent in at least the portion visible with the translatable top cover retracted.

5. The thumb drive of claim 4 fun her comprising a light-emitting device visible through the transparent portion of the fixed panel, the device changing color with data transfer.

* * * * *